United States Patent [19]

Deiger

[11] Patent Number: 4,919,326

[45] **Date of Patent: *Apr. 24, 1990**

[54] CONTAINER WITH IMPROVED RETENTION PROPERTIES AND IMPROVED CORNER STRUCTURES

[76] Inventor: Anthony J. Deiger, 2761 Riva Ridge Rd., Toledo, Ohio 43615

[21] Appl. No.: 310,108

[22] Filed: Feb. 10, 1989

[51] Int. Cl.[5] ..... B65D 5/56

[52] U.S. Cl. ..... 229/109; 220/418; 220/443; 220/462; 229/120; 229/906; 229/DIG. 14

[58] Field of Search ..... 219/10.55 E; 229/41 C, 229/41 D, 109, 150, 186, 906, DIG. 14, 169, 120, 2.5 R, 3.1; 426/107, 128, 130, 234, 127; 220/416, 418, 441, 443, 462, 902

[56] References Cited

U.S. PATENT DOCUMENTS

| | | | |
|---|---|---|---|
| 285,456 | 9/1883 | Brehmer . | |
| 1,052,564 | 2/1913 | Brown . | |
| 1,767,733 | 6/1930 | Brown . | |
| 1,865,742 | 7/1932 | Chapman | 229/2.5 R |
| 1,960,635 | 5/1934 | Kinkenon | 229/109 |
| 2,147,563 | 2/1939 | Turner | 229/35 |
| 2,646,916 | 7/1953 | Meller | 229/35 |
| 2,663,488 | 12/1953 | Gibbons | 229/36 |
| 2,784,900 | 3/1957 | Bauer | 229/35 |
| 2,819,833 | 1/1958 | Sauer | 229/41 |
| 3,067,921 | 12/1962 | Reifers | 229/2.5 R |
| 3,165,253 | 1/1965 | Adams et al. | 229/33 |
| 3,273,779 | 9/1966 | Mykleby | 220/416 |
| 3,276,900 | 10/1966 | Funck | 426/107 |
| 3,343,744 | 9/1967 | Morell et al. | 229/27 |
| 3,344,973 | 10/1967 | Studen | 220/441 |
| 3,512,697 | 5/1970 | Robinson | 229/109 |
| 3,542,282 | 11/1970 | Troth | 220/418 |
| 3,923,234 | 12/1975 | Lund, Jr. | 229/37 |
| 3,949,931 | 4/1976 | Hall | 229/120 |
| 4,058,214 | 11/1977 | Mancuso | 229/7.5 R |
| 4,190,757 | 2/1980 | Turpin et al. | 426/234 |
| 4,237,171 | 12/1980 | Laage et al. | 426/127 |
| 4,362,265 | 12/1982 | Williams | 229/32 |
| 4,391,833 | 7/1983 | Self et al. | 229/3.1 |
| 4,441,626 | 4/1984 | Hall | 426/127 |
| 4,765,534 | 8/1988 | Zion et al. | 229/169 |

FOREIGN PATENT DOCUMENTS

| | | | |
|---|---|---|---|
| 21682 | 3/1935 | Australia | 229/149 |
| 1320926 | 2/1963 | France | 229/41 C |
| 2329523 | 5/1977 | France | 229/DIG. 11 |
| 2408525 | 7/1979 | France | 229/109 |
| 2018226 | 10/1979 | United Kingdom | 229/DIG. 11 |
| 2116150 | 9/1980 | United Kingdom | 229/109 |

*Primary Examiner*—Gary Elkins

*Attorney, Agent, or Firm*—David C. Purdue; John C. Purdue

[57] ABSTRACT

Several embodiments of an improved container are disclosed. In one embodiment, the container has a rear side wall hinge and set-up panels extending therefrom so that it can be readily assembled from an integral prescored blank. Other embodiments relate to containers with improved thermal retention properties. According to one embodiment, a container is provided with an integral polymeric layer or foil layer which includes channels or depressions for releasing steam from a hot food product carried thereon. In another embodiment, a double side wall construction is provided and with vents for passing warm air between inner and outer side walls to warm the outside surface of the inner side wall to reduce the rate at which heat is transferred from inside the container through the inner side wall.

25 Claims, 6 Drawing Sheets

CONTAINER WITH IMPROVED RETENTION PROPERTIES AND IMPROVED CORNER STRUCTURES

BACKGROUND OF THE INVENTION

This invention relates to containers especially suited for protecting hot food products such as freshly baked pizza pies. More specifically, the invention is concerned with such containers featuring one or more expedients for preserving the integrity and quality of a pizza pie. In one embodiment, a container is provided with a protective and insulative laminate covering substantially all of the interior surface of the bottom of the container but not covering substantially all of the interior surface of the top of the container. In another embodiment, a container is provided having interior and exterior side walls spaced apart from one another and extending around at least a portion of the periphery of the container and vents for directing air heated by the hot pizza pie between at least a portion of the interior and exterior side walls for heat transfer with the former. A self erecting embodiment of the double wall container is disclosed. The vented double wall construction may advantageously be combined with the provision of a protective laminate on the bottom of the container to provide controlled thermal insulation and prevent migration between the pizza pie and the container.

There are a number of prior art containers designed especially for pizza pies. Conventional chipboard boxes are perhaps the least effective, in that they are flimsy before a pizza pie is placed inside. When a hot pie is placed in a chipboard container, the heat and moisture quickly warp and weaken the container making it wholly inappropriate for its purpose. Several conventional styles of double wall corrugated pizza boxes are in use today. These containers stand up better to heat and moisture than the chipboard containers, but they offer little or no advantage in terms of ease of assembly. Both types of prior art containers impart, to some degree, a cardboard taste to pizza.

U.S. Pat. No. 3,512,697 discloses an octagonal container in which diagonal corner elements reinforce the top and bottom. U.S. Pat. No. 4,765,534 discloses several embodiments of an octagonal pizza container with diagonal corner forming elements. Each one of the elements is connected to the bottom of the container and one of two adjacent side walls, but is disconnected from the other adjacent side wall.

There remains a need for a pizza container which is easy to assemble around a pizza while providing new levels of protection for the quality and integrity of the pizza contained therein.

SUMMARY OF THE INVENTION

In one respect, the invention is a container for pizza pies and similar hot food products and including an integral layer of polystyrene or similarly inert material covering substantially all of the inside surface of the bottom of the container. The upper surface of the polystyrene layer is preferably channelled so that moisture released from the food product can escape without making it soggy. The polystyrene material is largely confined to the inside surface of the bottom of the container to prevent excessive condensation within the container which would adversely affect the food product.

The instant invention is also based upon the discovery of a double side walled pizza container which can be assembled from an integral prescored blank. The container has a bottom, two side walls connected to and extending upwardly from the bottom, a top connected to one of said sidewalls, two sidewalls connected to and extending two opposed side walls, a rear wall and an opposed pair of set up panels which can be manipulated to set-up the carton from an integral prescored blank.

BRIEF DESCRIPTION OF THE DRAWINGS

In FIGS. 2 and 4, dotted lines represent scored or perfscored regions between connected elements.

DETAILED DESCRIPTION OF THE INVENTION

Figure 1:
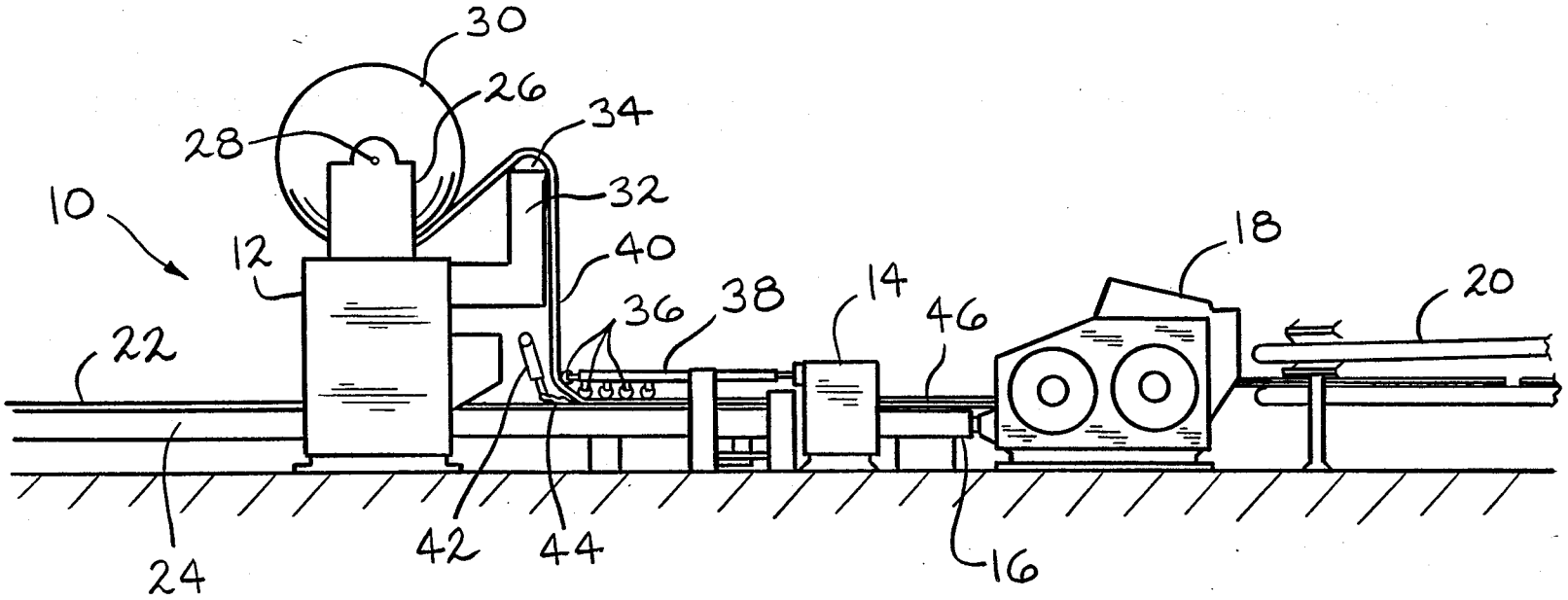
FIG. 1 is a side view of a corrugator to produce composite material comprising strips of insulative material adhered to portions of corrugated board.

A portion of a modified double face corrugating machine is indicated generally at 10 in FIG. 1. The corrugating machine 10 includes a pulley belt station 12, an automated slitter station 14, a transfer table 16, a cut-off knife 18 and a stacker 20. Corrugated material 22 moves through the corrugating machine 10 from left to right in FIG. 1 along a conveyor 24. The components of the corrugating machine 10 thus far described are conventional and can be modified in a manner described hereinbelow so that it can produce a composite corrugated material which can be die cut into a composite blank from which a container according to the present invention can be readily assembled.

A pair of bulk roll supports 26 are mounted on top of the pulley belt station 12. A shaft 28 is supported on the bulk roll supports 26 and extends across the conveyor 22. Rotatably supported on the shaft 28 are a plurality of rolls 30 of insulative cushioning material such as a foamed polystyrene or other elastomeric material. A guide bar 32 is secured to the pulley belt station 12. A roller 34 is rotatably supported on the guide bar 32. The roller 34 may include conventional means for guiding and positioning the strips of cushioning material supplied from the rolls 30 as well as means for tensioning the cushioning material as it passes over the roller 34. A plurality of pressure rollers 36 are rotatably mounted relative to a support bar 38. The pressure rollers 36 serve to apply pressure to cushioning material 40 as it passes between the pressure rollers 36 and the corrugated material 22. Together, the bulk roll supports 26, the shaft 28 and the guide bar 32 with its associated roller 34 constitute means for supplying strips of a cushioning material from a plurality of rolls 30 to be bonded to corrugated material 22 as it moves through the corrugating machine 10. These elements could be provided at a variety of positions along the corrugating machine 10. For economy of manufacture, it is desirable to bond cushioning material supplied from the rolls 30 to corrugated material 22 before it is cut and stacked.

A plurality of nozzles 42 are provided for applying a bonding agent, indicated at 44, delivered thereto by conventional equipment (not shown) to the upper surface of the corrugated material 22. The bonding agent 44 should have good adhesion properties relative to the cushioning material 40 supplied from the rolls 30 as well as to the corrugated material 22.

Accordingly, as the modified corrugating machine 10 is operated and corrugated material 22 advances from left to right, bonding agent 44 is applied to selected areas on the corrugated material 22. Cushioning material from the rolls 30 is then applied to selected areas of the corrugated material 22 where the bonding agent 44 has been applied. Finally, pressure rollers 36 serve to apply downward pressure to facilitate bonding of the strips of insulative, cushioning material 40 from the rolls 30 to the corrugated material 22 to produce a composite stock material 46. The stock material comprising corrugated material with parallel, spaced apart strips of insulative, cushioning material bonded thereto, advances to the automated slitter station 14 or the automated cutter station 18 for cutting to produce a composite blank of a desired size. The rolls 30 of cushioning material can have various widths, depending on the type and style of a container to be produced from a given stock material 54. Cushioning material composed of polymeric foam are produced commercially in very wide rolls. A plurality of rolls 30 of a desired width can be cut from a roll of commercial width cushioning material and used sequentially in apparatus of the type illustrated in FIG. 1. Several embodiments of composite containers which can be produced from the composite material 46 in accordance with this invention are described below.

Figure 2:
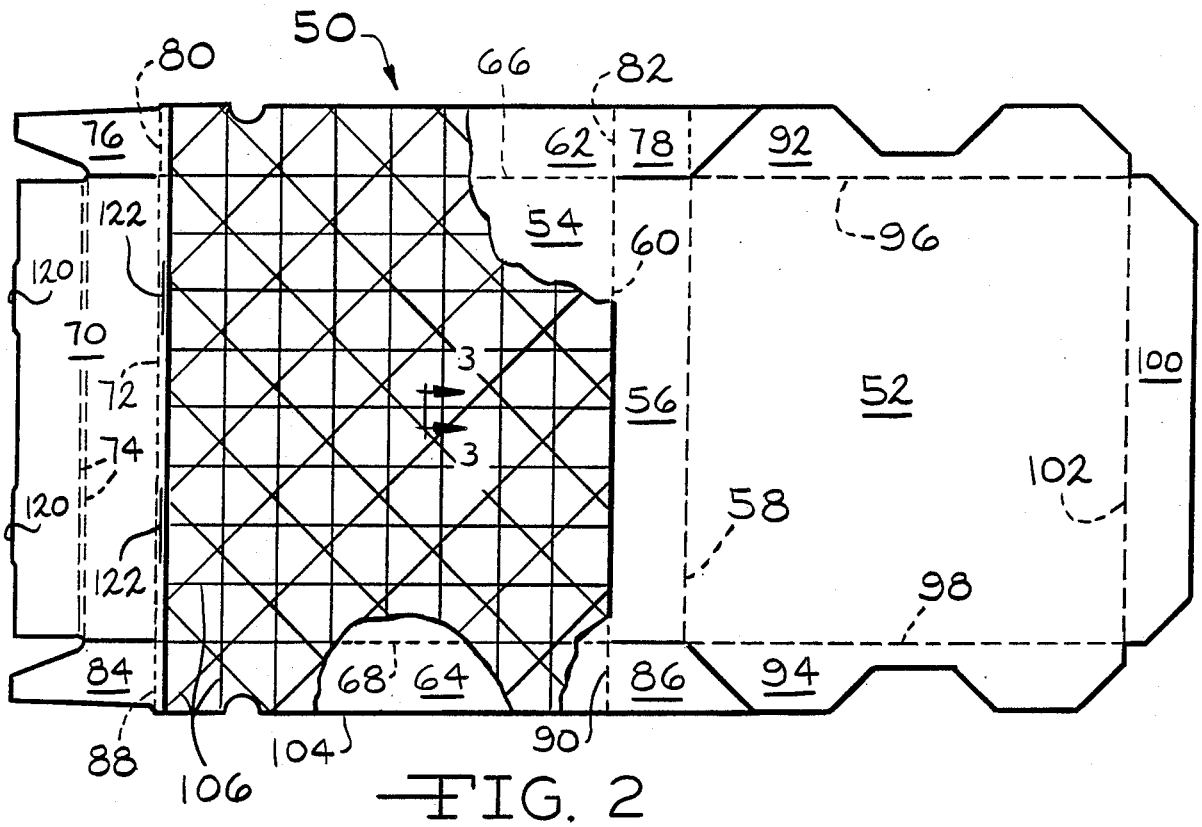
FIG. 2 is a plan view of a blank from which a container according to the present invention can be produced.

Referring to FIG. 2, there is illustrated a composite blank, indicated generally at 50, from which a container according to one embodiment of the invention can be produced. The blank 50 comprises a top panel 52, a bottom panel 54 and a rear wall 56 hingedly connecting the two panels 52 and 54 by means of fold lines 58 and 60. Opposed side walls 62 and 64 are connected to and extend outwardly from two edges of the bottom panel 54, defined by fold lines 66 and 68, respectively. A front panel 70 extends from and is connected to the front edge of the bottom panel 54, defined by a fold line 72. Double fold lines 74 are provided on the front panel 70 so that it can be folded to produce a double thick front wall. Reinforcing tabs 76 and 78 extend from opposite ends, defined by fold lines 80 and 82, of the side wall 62. Similarly, reinforcing tabs 84 and 86 extend from opposite ends, defined by fold lines 88 and 90, of the side wall 64. Side flaps 92 and 94 extend from side edges, defined by fold lines 96 and 98, respectively, of the top panel 52. A front flap 100 extends from the front edge, defined by fold line 102, of the top panel 52. This much of the blank 50 is composed, preferably, of double face corrugated material.

A layer of relatively thin insulative material 104 is adhered in face-to-face relationship with corrugated material constituting the bottom panel 54 and the side walls 62 and 64. The material 104, although broken away for illustrative purposes, extends from the free edge of the side wall 62 to the free edge of the side wall 64, and extends from the first one of the fold line 72 to the fold line 60. Thus, the blank 50 can be cut from a continuous sheet of composite material which can be produced on the modified double corrugating machine 10 (FIG. 1). The composite material would consist of a strip of the material 104, which could be supplied from the roll 30, adhered in face-to-face relationship with corrugated board. The insulative material 104 can be an extruded polystyrene which will act as a thermal insulator to keep a pizza hot and, because its integrity is unaffected by heat and moisture, it will insulate or protect the flavor of the pizza unlike the cardboard and corrugated board materials currently in use in pizza containers. Extruded polystyrene will not absorb oil or grease from a hot pizza.

As clearly shown in FIG. 2, the material 104 is adhered only to the bottom panel 54 and the two side walls 62 and 64. The other elements of the blank 50 are constituted only of corrugated board. It has been determined that, if a thermally insulative and water impervious material such as extruded polystyrene is adhered to most or all of the interior surfaces of a pizza container, when a pizza is closed up inside such a container, excessive condensation will occur inside the container to the extent that the pizza will become soggy and unpalatable. Accordingly, in a pizza container according to the present invention, insulative material is adhered to substantially all of the bottom panel and such material is not adhered to substantially all of the top panel. The side walls and the front wall and rear wall may or may not have insulative material adhered to them although, as noted above, there is a substantial manufacturing advantage attendant to bonding strips of insulative material to a portion of corrugated board, before it is cut into blanks. This eliminates the steps involved in cutting the insulative material by combining that step with the step of cutting the corrugated board. It should be appreciated that the function of the top panel 52 and the bottom panel 54 can be reversed by adhering the insulative material 104 to the top panel 52 and not to the bottom panel 54, if desired. The illustrated construction is preferred, however.

As shown in FIG. 2, the exposed surface of the insulative material 104 is patterned. Specifically, channels 106 are formed in the surface of the insulative material 104. The channels 106 constitute means for releasing steam and moist air from between the insulative material 104 and the crust of a pizza pie. Without such means, the underside of the pizza crust would become soggy and unappetizing. The particular type of channel pattern is not critical so long as it allows for the escape of moist air from between the insulative material and the underside of the pizza crust. The channels can be formed by an embossing die which could be combined with a cutting die. Alternatively, the channels could be formed in a separate step.

Figure 3:
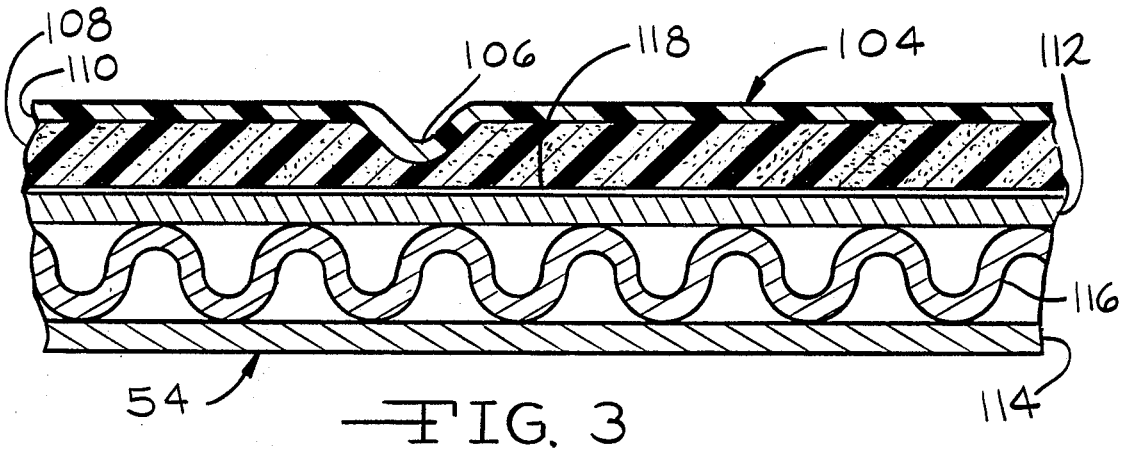
FIG. 3 is a sectional view taken along the line 3—3 of FIG. 2.

FIG. 3 illustrates a preferred type of insulative material 104 comprising a very thin sheet of extruded polystyrene 106 with an integral skin 108 consisting of high impact polystyrene laminated to the surface of the extruded polystyrene 106. The material 104 is commercially available and is preferred for use in pizza containers for "high volume" pizza shops where seconds count. The skin 108 is so durable that a whole pizza pie can be placed on the material 104 and cut into pieces, on the skin 108, without affecting its integrity. FIG. 3 also illustrates the interface between the insulative material 104 and the corrugated board consisting of first and second liners 112 and 114 and a fluted medium 120 therebetween. An adhesive layer 118 is provided between the first liner and the layer 108 of the insulative material 104. It is contemplated, within the scope of the present invention, that a foam material may be applied to corrugated board, still hot from the corrugator and that the residual heat would act to bond the foam to the corrugated material without the need for any separate adhesive.

It will be appreciated that insulative materials other than extruded polystyrene and extruded polystyrene with a skin of high impact polystyrene. For example, other foamed polymeric materials such as polyethylene could be used. In addition, materials such as foil could be laminated to the bottom panel of a container according to the present invention. Because foil is water impervious, channel means would be needed and they could entail depressions in the corrugated material of which the bottom panel was comprised. Other insulative materials will occur to those skilled in the art and they are contemplated within the scope of the invention.

The blank 50 shown in FIG. 2 is assembled in the following manner. Side walls 62 and 64 are folded upwardly along fold lines 66 and 68. Reinforcing tabs 76 and 84 are folded along fold lines 80 and 88 towards the front panel 70 which is folded upwardly along fold line 72 and downwardly, in half, along double fold lines 74 until tabs 120 engage slots 122 and the reinforcing tabs 76 and 84 are captured within the front wall of the container. Reinforcing tabs 78 and 86 are folded along fold lines 82 and 90 towards the rear wall 56 which is then folded upwardly along fold line 60. The flaps 92, 94 and 100 of the top panel 52 are folded along fold lines 96, 98 and 102, respectively and the top panel 52 is folded downwardly along fold line 58 to close the container and capture the reinforcing tabs 78 and 86 between the rear wall 56 and the flaps 92 and 94, respectively.

Figure 4:
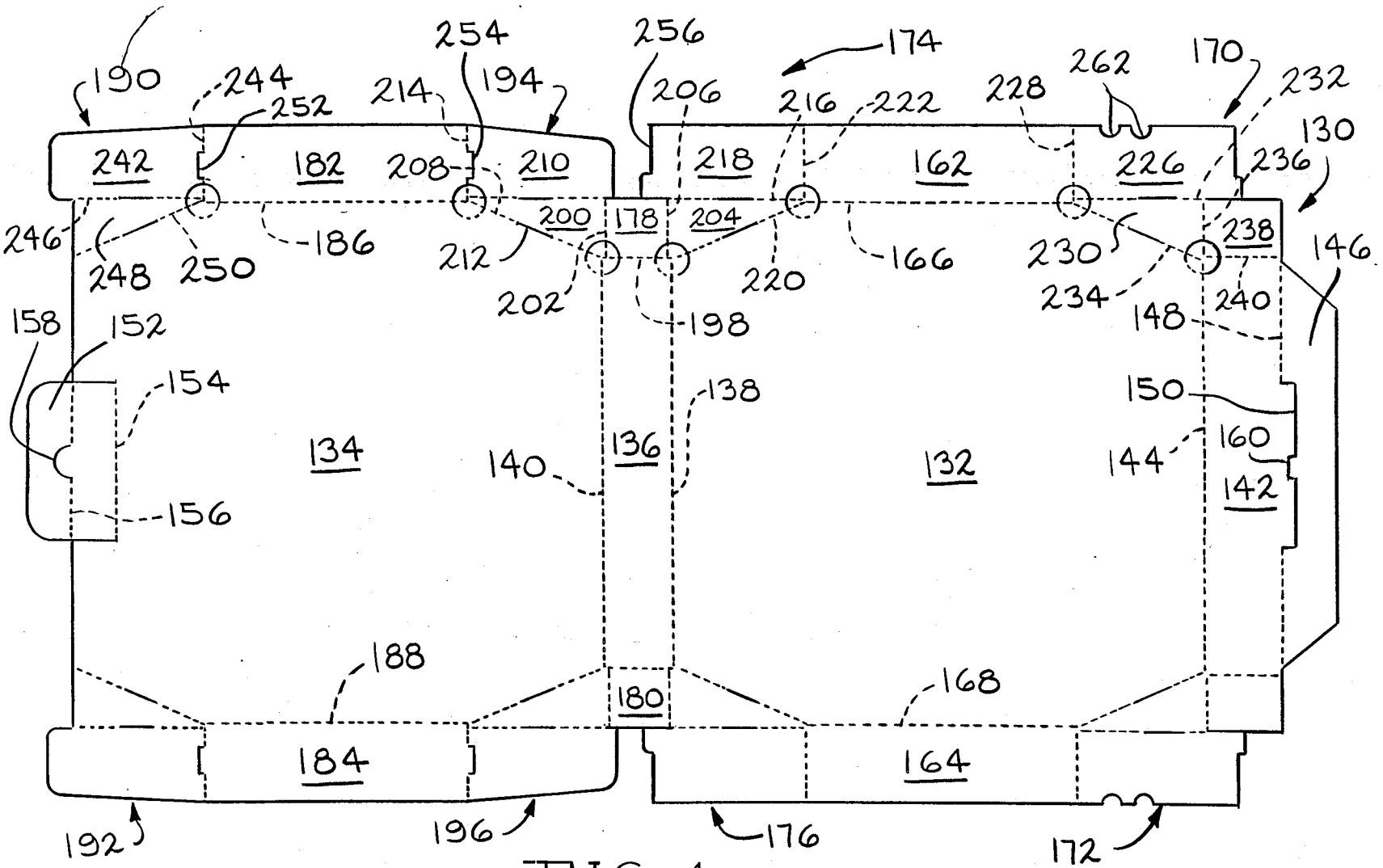
FIG. 4 is a plan view, drawn to scale, of the inside of a blank for a shallow, easy to assemble container, including steam vents.

Referring now to FIG. 4, a blank for producing a container according to a second embodiment of the instant invention is indicated generally at 130. The blank comprises a bottom panel 132, a top panel 134 and a rear wall 136 hingedly connecting the bottom and top panels 132 and 134 along lower and upper fold lines 138 and 140. A front wall 142 is connected to the front edge, defined by fold line 144, of the bottom panel 132. A flap 146, hingedly connected to the front wall 142 along a fold line 148, is slit at 150 to receive a portion of a closure flap 152 which is hingedly connected to the top panel along fold line 154 and includes a fold line 156. A tab 158 is exposed when the flap 152 is folded along the fold line 156. The tab 158 is adapted to engage a cut-out 160 which is exposed when the flap 146 is folded along the fold line 148. This is discussed in more detail in connection with FIG. 6.

Inner side walls 162 and 164 are connected to and extend from the bottom panel 132 along fold lines 166 and 168, respectively. Front, inner, diagonal wall structures 170 and 172 are connected to the bottom panel 132 and the side walls 162 and 164, respectively. Rear, inner diagonal wall structures 174 and 176 are connected to the bottom panel 132, the side walls 162 and 164, respectively, and set-up panels 178 and 180, respectively. Outer side walls 182 and 184 are connected to and extend from the top panel 134 along fold lines 186 and 188, respectively. Front, outer, diagonal wall structures 190 and 192 are connected to the top panel 134 and the side walls 182 and 184, respectively. Rear, outer diagonal wall structures 194 and 196 are connected to the top panel 134, the side walls 182 and 184, respectively, and set-up panels 178 and 180, respectively. The blank 130 is symmetrical about its longitudinal axis so side wall 182 corresponds with side walls 184, diagonal wall structure 174 corresponds with diagonal wall structure 176, etc. Accordingly, the following description of the elements in the upper half of FIG. 4 will apply as well to the corresponding elements in the bottom half of FIG. 4.

Set-up panel 178 is connected to one end of the rear wall 136 along fold line 198. Set-up panel 178 is also connected to an outer rear coupling panel 200 along fold line 202, and an inner rear coupling panel 204 along fold line 206. Outer rear coupling panel 200 is, in turn, connected along fold line 208 to an outer rear diagonal wall panel 210 and these elements together constitute the outer rear diagonal wall structure 194. The outer rear coupling panel 200 is connected along fold line 212 to the top panel 134 and the outer rear diagonal wall panel 210 is connected along fold line 214 to the outer side wall 182.

Similarly, inner rear coupling panel 204 is connected along a fold line 216 to an inner rear diagonal wall panel 218 and these elements together constitute the inner rear diagonal wall structure 174. The inner rear coupling panel 204 is connected along fold line 220 to the bottom panel 132 and the inner rear diagonal wall panel 218 is connected along fold line 222 to the inner side wall 162.

Figure 5:
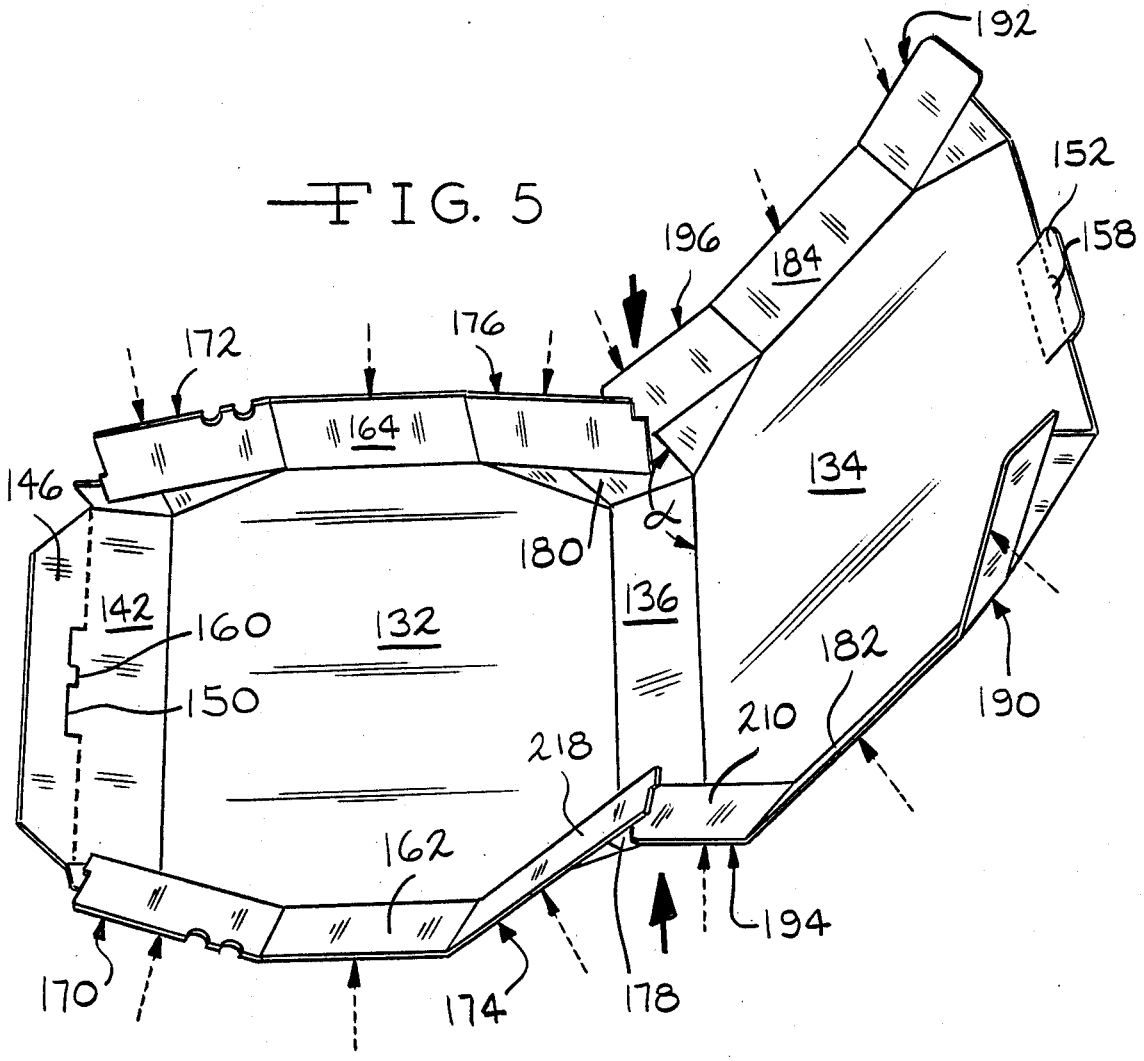
FIG. 5 is a perspective view of the blank shown in FIG. 4, during set-up.
Figure 6:
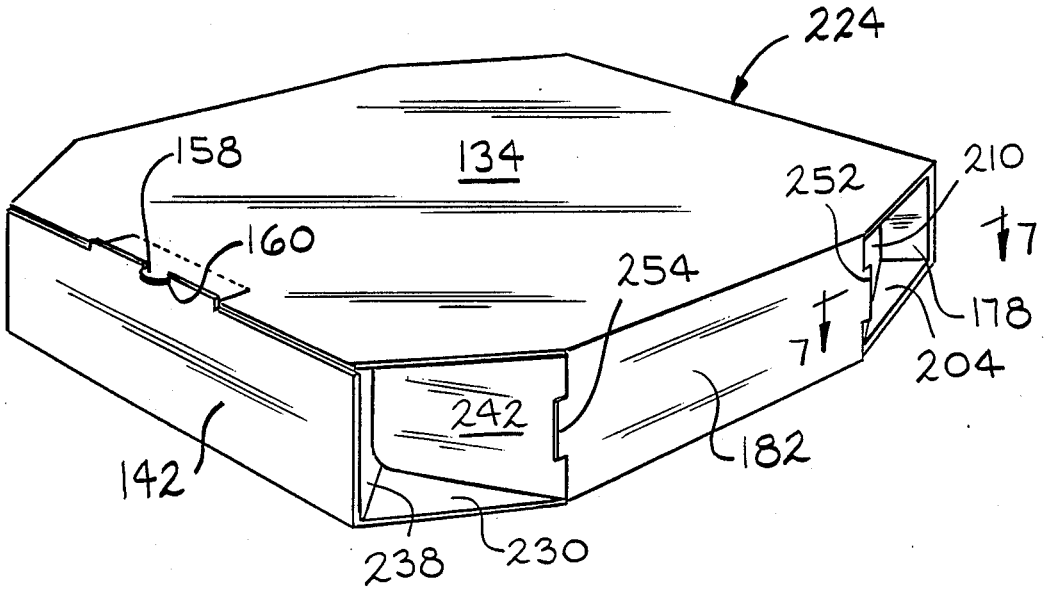
FIG. 6 is a perspective view of a fully closed container setup from the blank shown in FIGS. 4 and 5.

The illustrated blank 130 is self erecting in the sense that, the action of folding or pivoting the set-up panel 178 upwardly about the fold line 198 and similarly folding the set-up panel 180 about the fold line corresponding with 198 (this is represented in FIG. 5 by bold arrows), assuming a condition where the bottom is anchored, for example, by the weight of a payload (not shown) resting on the bottom panel 132, will create the reactions represented in FIG. 5 by arrows with dotted tails. The initiation of the reactions represented in FIG. 5 can be facilitated by combining inward and upward pressure on the setup panels 178 and 180 with a slight lifting force exerted on the top panel 134. Once the reactions begin, however, the lifting force is not required to sustain the reactions represented by the arrows with dotted tails. Continued pressure on the set-up panels 178 and 180 in the direction of the bold arrows will sustain the reactions. When the set-up has progressed a little beyond the point illustrated in FIG. 5, an angle $\alpha$ between the rear wall 136 and the set-up panel 180, and a corresponding angle between the rear wall 136 and the set-up panel 178, will be less than 90°. At that point, rapid and sure closure of the blank can be effected by squeezing together the set-up panel 180 and the rear wall 136 on the one side and the set-up panel 178 and the rear wall 136 on the other side. This squeezing action can be utilized to bring the diagonal wall structures 190 and 192 down around the diagonal wall structures 170 and 172 at which time the closure means can be utilized to fasten closed the erected container 224 as shown in FIG. 6. In this embodiment, fastening is effected by inserting the closure flap 152 through the slit 150 and engaging the tab 158 in the cutout 160. Other means for fastening the container 224 in a closed position can be utilized, of course, and one example of other fastening means will be discussed below in connection with FIGS. 10 and 11. First, additional features of the blank 130 will be discussed with reference to FIG. 4, 5 and 6.

The top panel 134 and associated elements are sized, relative to the bottom panel 132 and associated elements so that, during the set-up described above in connection with FIGS. 5 and 6, the outer side walls 182 and 184 are guided by the reactions to be outside of the inner side walls 162 and 164 in the set-up container 224. So too are the outer, rear diagonal wall panel 210 and the corresponding outer, rear diagonal wall panel guided to be outside of the inner, rear diagonal wall panel 218 and the corresponding inner rear diagonal wall panel, in the setup container 224. Specifically, the top panel 132 is sized to be slightly larger than the bottom panel 134 and the inner rear coupling panel 204 is slightly longer along the fold line 216 than is the outer rear coupling panel 200 along the fold line 208. In addition, there are several offsets between adjacent fold lines and these are circled. The amount of offset in each case is between approximately one sixteenth (1/16) and one eighth (⅛) of an inch. The amount of offset in a particular location is not critical, nor is the amount by which the top panel 134 and the coupling panel 204 are larger than bottom panel 132 and coupling panel 200, so long as they are controlled to produce the reactions described above in connection with FIG. 5.

Referring again to FIG. 4, the inner diagonal wall structure 170 of the blank 130 comprises an inner front diagonal panel 226 connected to and extending from the inner side wall 162 along a fold line 228. The diagonal panel 226 is also connected to an inner coupling panel 230 along a fold line 232. The coupling panel 230 is also connected, along a fold line 234, to the bottom panel 132, and is connected, along a fold line 236, to a reverse, inner, diagonal wall panel 238. The wall panel 238 is connected, along a fold line 240, to the front wall 142. The front, outer diagonal wall structure 190 comprises a front, outer diagonal wall panel which is connected along a fold line 244 to the outer side wall 182, and is connected, along a fold line 246, to a front, outer coupling panel 248. The coupling panel is also connected, along a fold line 250, to the top panel 134. The set-up described above in connection with FIG. 5 creates reactions in the components of the top and bottom front diagonal wall structures and the reactions are represented in FIG. 5 by arrows with dotted tails.

Figure 7:
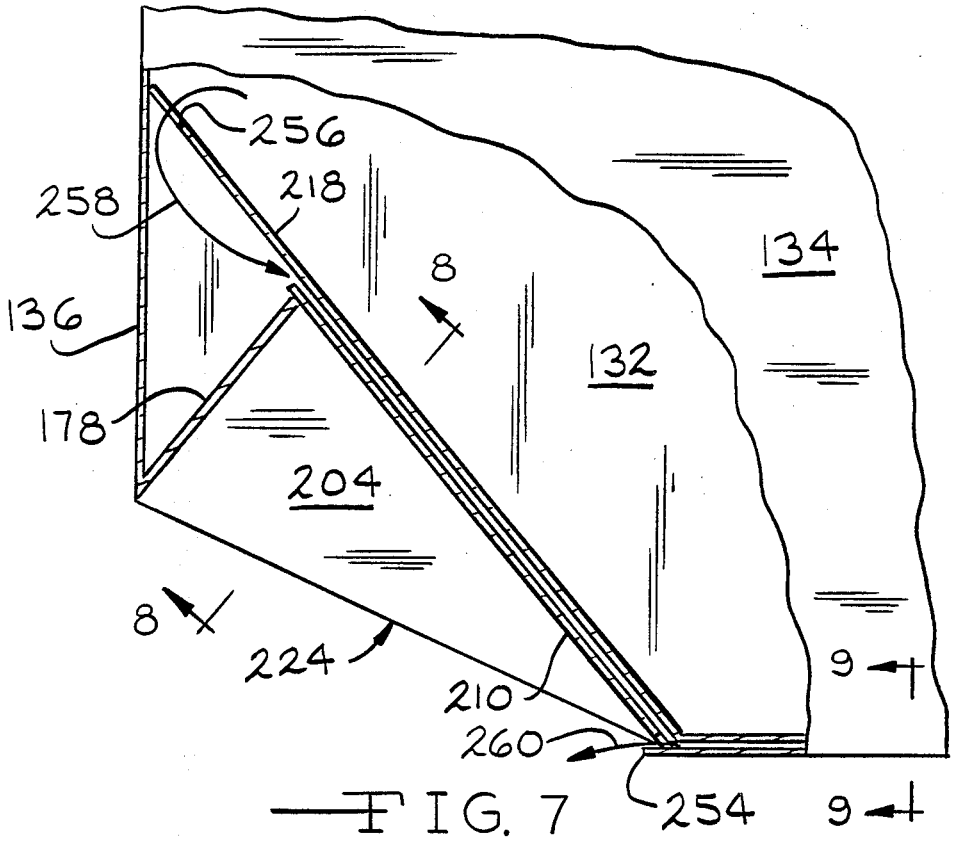
FIG. 7 is a sectional view taken along the line 7—7 of FIG. 6.
Figure 8:
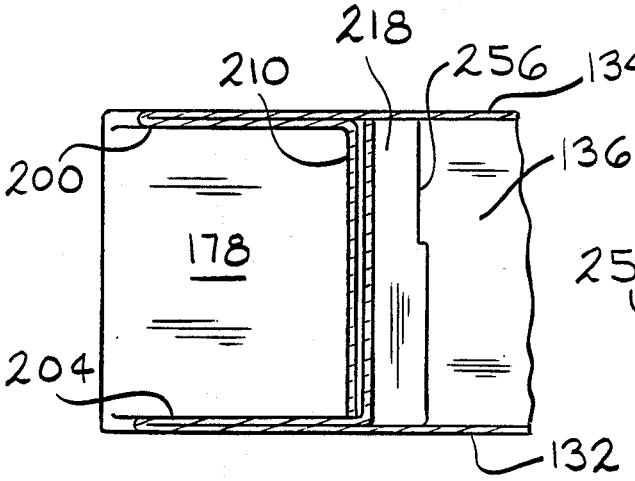
FIG. 8 is a sectional view taken along the line 8—8 of FIG. 7.
Figure 9:
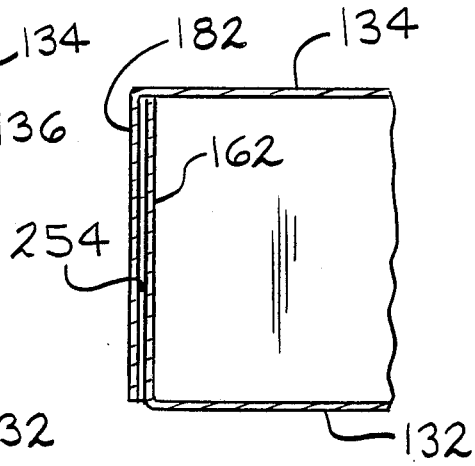
FIG. 9 is a sectional view taken along the line 9—9 of FIG. 8.

At opposite ends of the outer side wall 182, there are provided vent slots 252 and 254. One or both of the vent slots 252 and 254 may be provided to allow hot moist air to escape from between the outer, front diagonal wall panel 242 and the inner, front diagonal wall panel 226. Hot moist air is vented from the inside of the container 224 through an opening defined the rear wall 136 and a cut out 256 provided on the inner, rear diagonal panel 218. This relationship is better illustrated in FIG. 7 where the flow of hot moist air out of the inside of the container 224 is represented by an arrow 258. The hot, moist air is vented to the atmosphere by passing between the panels 210 and 218 and escaping, as represented by an arrow 260, through the vent slot 254. This flow of air between the panels 210 and 218 will transfer heat to and raise the temperature of the outside of panel 218, consequently reducing the rate at which heat is transferred through the panel 218. Thus, the illustrated vent arrangement uses hot moist air to transfer heat to the panel 218 and thereby reduce the rate at which heat is lost from inside the container 224. Similarly, vents 262 will vent hot, moist air from inside the container 224 to flow between the panels 226 and 242 and out from between these panels through the vent slot 252.

Figure 10:
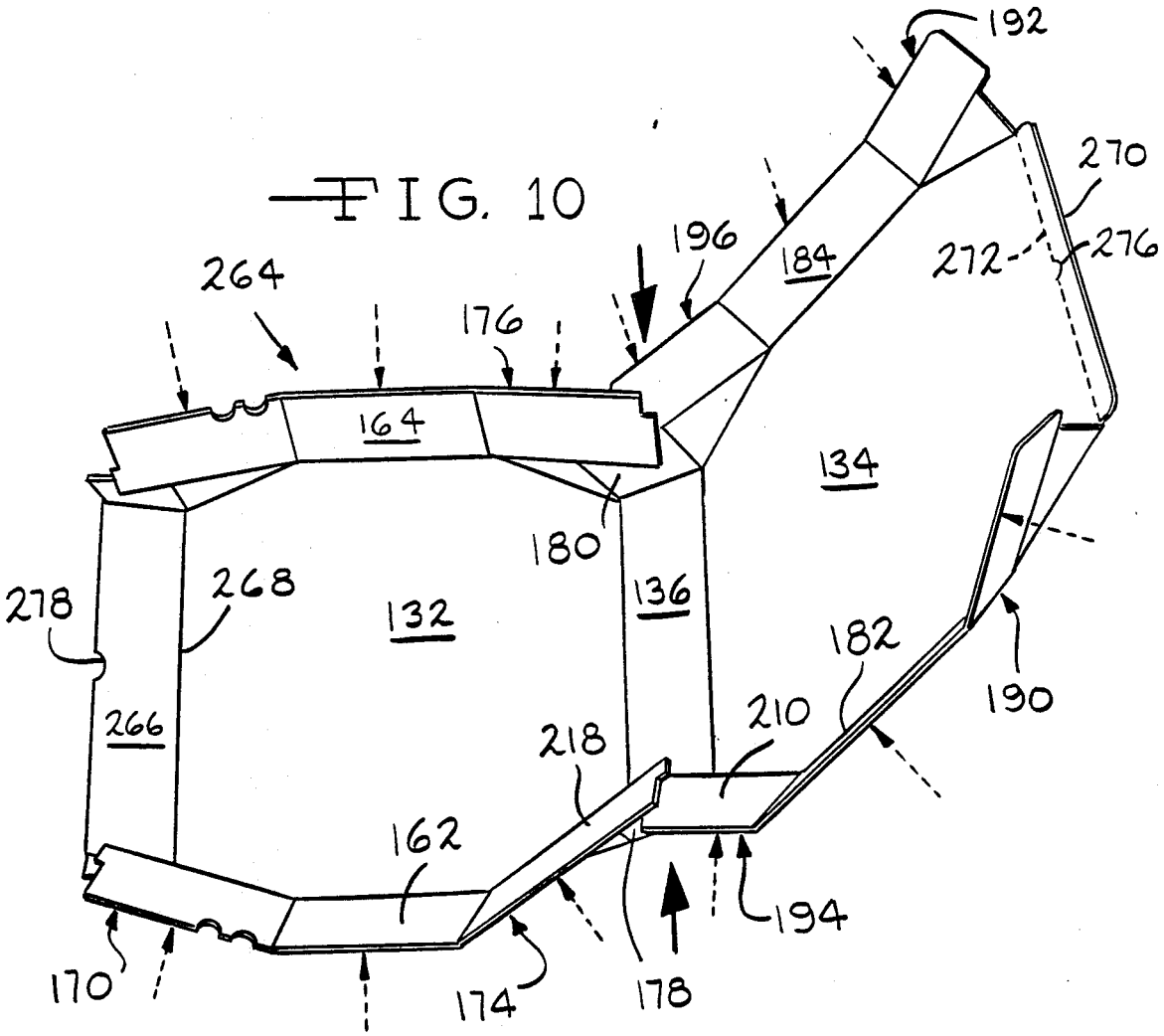
FIG. 10 is a perspective view of a blank, during set-up, which blank is similar to the blank illustrated in FIG. 5.
Figure 11:
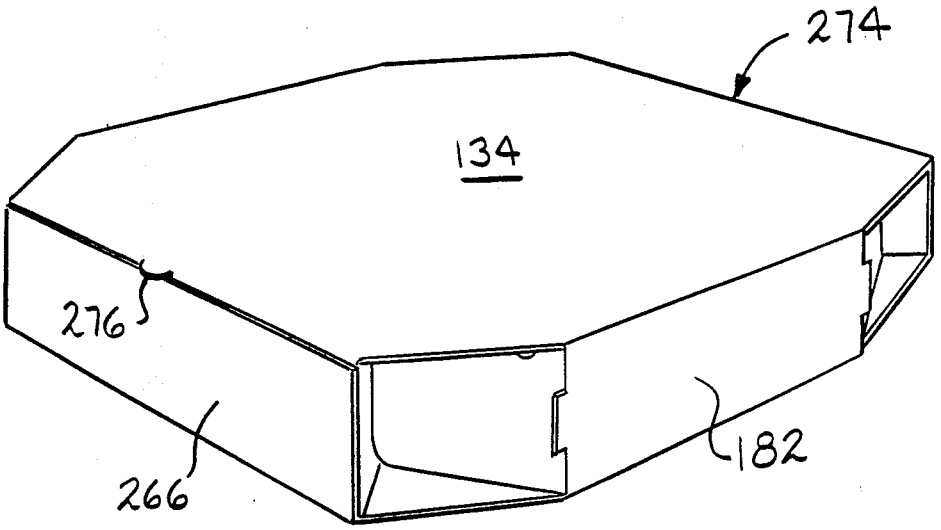
FIG. 11 is a perspective view of a fully closed container setup from the blank shown in FIG. 10.

FIGS. 10 and 11 illustrate a blank 262 corresponding with the blank 130 except for the details of construction of the means for fastening the blank 262 in a closed position. Specifically, a front wall 266 is connected, along a fold line 268, to the bottom panel 132. A closure flap 270 is connected to the top panel 134 along a fold line 272. The flap is received between the front wall 266 and the reverse, front diagonal panel 238, on one side and the corresponding reverse, front diagonal panel on the other side, thereby fastening the container 274 closed. Additional fastening is provided by a tongue 276 which is received in a cut-out 278.

The foregoing detailed description is intended to enable one skilled in this art to practice the invention, rather than to limit the invention. Modifications may occur to those skilled in the art, but fall, nonetheless, within the spirit and scope of the following claims.

I claim:

1. A shallow container for hot food products such as pizza pies, said container comprising a bottom panel having an inside surface and an outside surface, a top panel having an inside and an outside surface, a rear wall hingedly connecting said top and bottom panels, two opposed walls having inside and outside surfaces, said side walls being connected to said top or bottom panel, a front wall connected to said top or bottom panel, a sheet of insulative, foamed polymeric material having first and second opposed major surfaces, said first major surface being bonded to and covering substantially all of the inside surface of said bottom panel, in face-to-face relationship therewith, said inside surface of said top panel being substantially free of insulative, foamed polymeric material, and means provided in said second opposed major surface of said sheet of insulative, foamed polymeric material for releasing moist air from between said second opposed major surface of said sheet of insulative, foamed polymeric material and a hot food product carried thereon.

2. The container claimed in claim 1 wherein said sheet of insulative, foamed polymeric material is bonded to substantially all of the interior surfaces of said side walls.

3. The container claimed in claim 1 or 2 wherein said insulative, foamed polymeric material is composed of polystyrene.

4. The container claimed in claim 3 wherein the second major surface of said sheet of insulative, foamed polymeric material is composed of high impact polystyrene.

5. A shallow container formed from a unitary, prescored blank and comprising:

a bottom panel a top panel, a first side wall hingedly connecting said top and bottom panels, said side wall having first and second ends, second third outer side walls connected to and depending from one of said bottom and top panels, second and third inner side walls connected to and depending from the other of said bottom and top panels, at least one fourth side wall connected to and depending from one of said top and bottom panels and closure means connected thereto for selectively maintaining said top panel in a closed position, first and second pairs of inner and outer rear diagonal side wall panels connected to said second inner and outer side walls and said third inner and outer side walls, respectively, first and second pairs of inner and outer coupling panels connecting each of said first and second pairs of inner and outer rear diagonal wall panels to said top and bottom panels, and first and second set-up panels connected, respectively, to said first and second ends of said first side wall, said first and second set-up panels also being connected, respectively, to said first and second pairs of inner and outer coupling panels.

6. The container claimed in claim 5 wherein said second and third outer side walls are connected to said top panel and wherein said second and third inner side walls are connected to said bottom panel.

7. The container claimed in claim 5 or 6 which is produced from a blank which is scored so that said set-up panels can be manipulated to effect set-up of said second and third outer side walls, said second and third inner side walls and said first and second pairs of inner and outer rear diagonal side wall panels.

8. The container claimed in claim 5 or 6 wherein said fourth side wall is connected to said bottom panel.

9. The container claimed in claim 8 wherein said closure means comprise a flap connected to said top panel, a tab connected to and extending from said top panel, means on said fourth wall defining a slot for receiving a portion of said flap and cut-out means provided on said fourth wall for receiving said tab.

10. The container claimed in claim 5 which additionally includes first and second pairs of inner and outer front diagonal side wall panels connected to said second inner and outer side walls and said third inner and outer side walls, respectively.

11. The container claimed in claim 10 which additionally includes first and second pairs of inner and outer coupling panels connecting each of said first and second pairs of inner and outer front diagonal wall panels to said top and bottom panels, respectively.

12. The container claimed in claim 10 or 11 which is produced from a blank which is scored so that said set-up panels can be manipulated to effect set-up of said second and third outer side walls, said second and third inner side walls, said first and second pairs of inner and outer rear diagonal side wall panels and said first and second pairs of inner and outer front diagonal wall panels.

13. The container claimed in claim 11 which additionally includes first and second reverse, front diagonal side wall panels connecting said fourth side wall to said first and second inner coupling panels.

14. The container claimed in claim 13 which is produced from a blank which is scored so that said set-up panels can be manipulated to effect set-up of said second and third outer side walls, said second and third inner side walls, said first and second pairs of inner and outer rear diagonal side wall panels, said first and second pairs of inner and outer front diagonal wall panels and said first and second reverse front diagonal side wall panels.

15. The container claimed in claim 13 wherein said closure means comprise a closure flap connected to and extending from said top panel, said closure panel being releasably receivable between said fourth side wall and said first and second reverse, front diagonal side wall panels.

16. The container claimed in claim 5 which additionally includes vent means for allowing warm air to flow from the inside of the container, between inner and outer portions of the container, and out from between said inner and outer portions, so as to reduce the rate at which heat is transferred through said inner portion from the interior of the container.

17. The container claimed in claim 16 wherein said inner portion comprises at least one of said inner rear diagonal side wall panels and said outer portion comprises said outer rear diagonal side wall panels.

18. The container claimed in claim 16 or 17 wherein said outer portion comprises said first side wall.

19. A shallow container formed from a unitary, prescored blank and comprising:

a bottom panel a top panel, a first side wall hingedly connecting said top and bottom panels, second and third outer side wall means connected to and depending from one of said bottom and top panels and second and third inner side wall means connected to and depending from the other of said bottom and top panels, said second and third inner and outer side wall means defining at least one channel therebetween, a fourth side wall connected to and depending from one of said top and bottom panels and closure means connected thereto for selectively maintaining said top panel in a closed position, first vent means defining an inlet through which warm air from the inside of the container can enter said at least one channel, and second vent means spaced from said first vent means and defining an outlet through which warm air can exit said at least one channel, wherein, warm air entering said at least one channel from inside the container raises the temperature within said at least one channel, so as to reduce the rate at which heat is transferred through said inner side wall means from the interior of the container.

20. A shallow container formed from a unitary, prescored blank and comprising:

a bottom panel a top panel, a first side wall hingedly connecting said top and bottom panels, second and third side walls connected to and depending from said bottom panel, a fourth side wall connected to and depending from said bottom panel, said fourth side wall having first and second ends, first and second front diagonal side wall panels connected to said second and third side walls, first and second coupling panels connecting each of said first and second front diagonal wall panels to said bottom panel, first and second reverse, front diagonal side wall panels connecting said first and second ends of said fourth side wall to said first and second coupling panels, and closure means for selectively maintaining said container in a closed position.

21. The container claimed in claim 20 wherein said closure means comprise a flap connected to said top panel, a tab connected to and extending from said top panel, means on said fourth side wall defining a slot for receiving a portion of said flap and cutout means provided on said fourth side wall for receiving said tab.

22. The container claimed in claim 20 wherein said closure means comprise a closure flap connected to and extending from said top panel, said closure panel being releasably receivable between said fourth side wall and said first and second reverse, front diagonal side wall panels.

23. A shallow container formed from a unitary, prescored blank and comprising:

a bottom panel a top panel, a first side wall hingedly connecting said top and bottom panels, second and third outer side walls connected to and depending from said top panel, second and third inner side walls connected to and depending from said bottom panel, a fourth side wall connected to and depending from said bottom panel, said fourth side wall having first and second ends, first and second pairs of inner and outer rear diagonal side wall panels connected to said second inner and outer side walls and said third inner and outer side walls, respectively, first and second pairs of inner and outer coupling panels connecting each of said first and second pairs of inner and outer rear diagonal wall panels to said top and bottom panels, and first and second set-up panels connected, respectively, to said first and second ends of said first side wall, said first and second set-up panels also being connected, respectively, to said first and second pairs of inner and outer coupling panels, first and second pairs of inner and outer front diagonal side wall panels connected to said second and third side walls, third and fourth pairs of coupling panels connecting each of said first and second pairs of inner and outer front diagonal wall panels to said top and bottom panels, first and second reverse, front diagonal side wall panels connecting said first and second ends of said fourth side wall to said coupling panels which are connected to said inner front diagonal wall panels, and closure means for selectively maintaining said container in a closed position.

24. The container claimed in claim 23 which is produced from a blank which is scored so that said set-up panels can be manipulated to effect set-up of said second and third outer side walls, said second and third inner side walls, said first and second pairs of inner and outer rear diagonal side wall panels, said first and second pairs of inner and outer front diagonal wall panels and said first and second reverse front diagonal side wall panels.

25. A shallow container for hot food products such as pizza pies, said container comprising a bottom panel having an inside surface and an outside surface, a top panel having an inside and an outside surface, a rear wall hingedly connecting said top and bottom panels, two opposed side walls having inside and outside surfaces, said side walls being connected to said top or bottom panel, a front wall connected to said top or bottom panel, a sheet of foil material having first and second opposed major surfaces, said first major surface being bonded to and covering substantially all of the inside surface of said bottom panel, in face-to-face relationship therewith, said inside surface of said top panel being substantially free of foil material, and depressions provided in said sheet of foil material for releasing moist air from between said second opposed major surface of said sheet of foil material and a hot food product carried thereon.

* * * * *